US009335131B2

(12) United States Patent
Devaux

(10) Patent No.: US 9,335,131 B2
(45) Date of Patent: May 10, 2016

(54) ILLUMINATION DEVICE WITH SELECTIVE INCAPACITATING POWER

(71) Applicant: BRISON S.A., Luxembourg (LU)

(72) Inventor: Fabrice Devaux, Le Mont sur Lausanne (CH)

(73) Assignee: BRISON S.A., Luxembourg (LU)

( * ) Notice: Subject to any disclaimer, the term of this patent is extended or adjusted under 35 U.S.C. 154(b) by 0 days.

(21) Appl. No.: 14/427,215

(22) PCT Filed: Sep. 6, 2013

(86) PCT No.: PCT/FR2013/000231

§ 371 (c)(1),
(2) Date: Mar. 10, 2015

(87) PCT Pub. No.: WO2014/037631

PCT Pub. Date: Mar. 13, 2014

(65) Prior Publication Data

US 2015/0233682 A1 Aug. 20, 2015

(30) Foreign Application Priority Data

Sep. 10, 2012 (FR) ..... 12 02404

(51) Int. Cl.
*F41H 13/00* (2006.01)

(52) U.S. Cl.
CPC ..... *F41H 13/0087* (2013.01); *F41H 13/0056* (2013.01)

(58) Field of Classification Search
CPC ..... F41H 13/0087; F41H 13/0056
USPC ..... 362/110–114; 250/221, 222.1; 42/146, 42/1.08; 89/1.11
See application file for complete search history.

(56) References Cited

U.S. PATENT DOCUMENTS

| | | | | |
|---|---|---|---|---|
| 7,180,426 | B2 * | 2/2007 | Rubtsov | F41H 13/0087 340/321 |
| 7,220,957 | B2 * | 5/2007 | Choi | F41H 13/0087 219/121.63 |
| 8,375,838 | B2 * | 2/2013 | Rudakevych | F41A 19/58 700/245 |
| 2005/0243224 | A1 | 11/2005 | Choi et al. | |
| 2006/0119483 | A1 | 6/2006 | Rubtsov | |
| 2007/0039226 | A1 | 2/2007 | Stokes | |
| 2008/0121097 | A1 * | 5/2008 | Rudakevych | F41A 19/58 89/28.05 |

FOREIGN PATENT DOCUMENTS

| | | | |
|---|---|---|---|
| FR | 2753898 | A1 | 4/1998 |
| FR | 2886394 | A1 | 12/2006 |

OTHER PUBLICATIONS

Nov. 4, 2013 International Search Report issued in International Patent Application No. PCT/FR2013/000231.

* cited by examiner

*Primary Examiner* — Michael David
(74) *Attorney, Agent, or Firm* — Oliff PLC

(57) ABSTRACT

An emitter emits a wavelength included in the visible and/or infrared spectrum to illuminate a scene. An observation system is configured to deliver an image representative of the illuminated scene to an observer. The emitter is configured to deliver a light emission by at least one flash with a luminous power greater than a threshold generating dazzling. The observation system presents a first operating condition and a second operating condition of the observed scene to the observer, the second operating condition transmitting less luminous power than the first operating condition. A synchronization circuit is configured to synchronize the emitter and the observation system so that the observer is not dazzled during the emission phase of the emitter.

8 Claims, 1 Drawing Sheet

ILLUMINATION DEVICE WITH SELECTIVE INCAPACITATING POWER

BACKGROUND OF THE INVENTION

The invention relates to an illumination device comprising an electromagnetic radiation emitter and an observation system.

STATE OF THE ART

In the field of maintaining order, non-lethal weapons occupy a privileged place as they enable the risks of injuries between opponents to be limited.

Different types of non-lethal weapons exist that enable a person to be disoriented without sending a solid projectile in order to limit the risks of accidents.

The documents US 2006/0119483 and US 2007/0039226 describe devices for generating a light radiation configured to have an incapacitating effect on a person.

However, the use of these weapons is not adapted to particular configurations where several persons have to be controlled or when the law enforcement authorities have to intervene within a confined area.

The documents US 2005/243224 and FR 2886394 describe devices for temporarily neutralizing a person. These devices comprise a pulsed light source coupled with observation means. Synchronization is performed by means of the pulsed light source which emits a warning signal to observation means.

OBJECT OF THE INVENTION

It is observed that a requirement exists to provide a device for illuminating a scene that enables a part of the persons present to be disabled without interfering with the action of the law enforcement forces.

This requirement tends to be met by means of a device which comprises:

- an electromagnetic radiation emitter having a wavelength comprised in the visible spectrum and/or in the infrared range and designed to illuminate a scene,
- an observation system configured to deliver an image representative of the illuminated scene to an observer carrying said observation system,
- a device wherein:
- the emitter is configured to deliver an emission of the electromagnetic radiation by at least one flash with a luminous power greater than a threshold generating dazzling,
- the observation system is configured to present a first operating condition and a second operating condition, the second operating condition transmitting less luminous power to the observer than the first operating condition,
- a synchronization circuit configured to synchronize the emitter and the observation system so that the observer is not dazzled during the emission phase of a flash of the emitter,
- the emitter and the observation system each comprise a clock and a memory incorporating the distribution pattern of the flashes in time and the synchronization circuit comprises a transmission/receipt circuit of a synchronization signal configured to initialise synchronization of the emitter and of the observation system.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF PREFERRED EMBODIMENTS OF THE INVENTION

Figure 1:
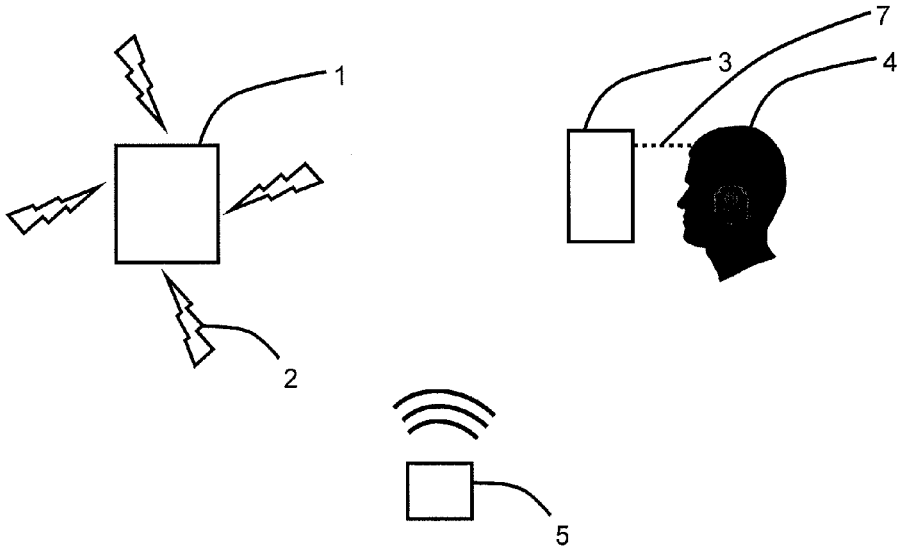
FIGS. 1 and 2 represent, in schematic manner, in cross-section, illumination devices with a radiation emitter and an observation system.

The illumination device comprises an emitter 1 of electromagnetic radiation 2 having a wavelength comprised in the visible spectrum and/or in the infrared range. Emitter 1 of electromagnetic radiation 2 can be configured to simultaneously emit in the visible spectrum and in the infrared spectrum or it can be configured to emit either in the visible spectrum or in the infrared range.

Emitter 1 of electromagnetic radiation 2 is designed to illuminate a scene and advantageously a target located in the illuminated scene.

The illumination device also comprises an observation system 3 which is configured to deliver an image representative of the illuminated scene to an observer 4. Observation system 3 is configured to be portable so that observer 4 is able to carry observation system 3 to the area that is to be illuminated by emitter 1.

In order to hamper the target located in the illuminated scene, emitter 1 is configured to deliver an emission of electromagnetic radiation 2 by at least one flash or by several flashes with a luminous power greater than a threshold generating dazzling of the target, for example a person or a detection system. In this way, the illuminated target is disoriented and becomes less dangerous for its external environment. The emitted power can be a function of the estimated distance between light emitter 1 and target. In preferential manner, the estimated distance is comprised between a few meters and about 50 meters. The energy emitted to obtain the incapacitating effect depends on the conditions of use. The luminous energy emitted is in fact greater if the target is in a well-lit environment than in a dark environment. It is also necessary to provide a greater amount of energy if the target is in an open space in comparison with a confined space in which a part of the luminous energy emitted is reflected by walls or other objects present. The maximum luminous energy emitted can also be fixed by means of a specific norm and/or regulation in order to prevent the target's eyes from being burnt.

In an alternative embodiment, the emitter is a laser source. In this configuration, the emitter is advantageously configured to dazzle, for example a sensor performing control of the trajectory of a mobile device.

Observation system 3 is configured to present a first operating condition and a second operating condition. These two operating conditions are differentiated by modifying the transmission characteristics of the observed scene to observer 4.

The first operating condition defines a first value or a first set of values of the luminosity perceived in the illuminated environment transmitted to observer 4. The second operating condition is chosen so as to present a second value or a second set of values in which less received luminous energy is transmitted to observer 4.

In other words, the second operating condition is chosen such as to transmit less luminous power than the first operating condition, at equivalent received illumination. The observation system thus enables the user to observe the illuminated scene under two different illumination conditions.

The second operating condition can represent an absence of transmission of the received luminous energy.

Observation system 3 can be formed by any suitable device which enables an observer 4 to watch a scene, for example a pair of glasses, a film camera, or an infrared viewing device.

As emitter 1 generates an electromagnetic radiation by flashes, the scene presents two very different illumination periods. In a first period, the scene is weakly lit by emitter 1 or the scene is not lit by emitter 1. Observer 4 can observe the scene clearly as observation system 3 transmits all or most of the incident radiation. In a second illumination period, emitter 1 generates a very powerful flash. Observation system 3 switches to second operating mode in order to limit the luminous energy sent to observer 4 and to avoid observer 4 being dazzled. Thus, in the second period, the scene is strongly lit and the target is dazzled. Observer 4 is not dazzled as observation system 3 then transmits little or no radiation.

The illumination device further comprises a synchronization circuit 5 which is configured to synchronize emitter 1 and observation system 3 so that observer 4 is not dazzled during the emission phase of the flashes and that he receives a sufficient quantity of light between two flashes.

As emitter 1 generates light flashes of short duration and strong intensity, the human or animal eye is not able to adapt itself and a person subjected to this type of illumination is disoriented.

The same is true for a large number of electronic devices whose control circuits are not always able to modify the operating conditions in order to follow such an illumination. The use of synchronization circuit 5 enables observation system 3 to anticipate the flashes.

In a particular embodiment, light emitter 1 emits a first electromagnetic radiation in a specific wavelength range, for example at a first wavelength, in order to perform synchronization. In preferential manner, the first electromagnetic synchronization radiation uses a first wavelength or a first wavelength rang which is different from the wavelength or the wavelength range used by the flashes.

Synchronization is performed by a first electromagnetic radiation in the visible range or preferably in the infrared range. The first electromagnetic radiation can also be in a different range, for example the radiofrequency range. The first electromagnetic radiation is received by observation system 3. The first electromagnetic radiation can be emitted by emitter 1 or by another device.

In a particular embodiment, emitter 1 comprises an emission circuit of a first electromagnetic radiation preceding emission of a dazzling flash by a predefined time lag. The first electromagnetic radiation can be achieved by a more or less long emission of a signal. The signal sent can be simple, for example a peak, a square signal or different symbols. The signal can be more complex, for example a plurality of peaks, of square signals or symbols having variable durations.

The first electromagnetic radiation precedes the dazzling flash by a predefined time lag. In a particular case, this time lag is fixed. In another embodiment, the time lag is variable and the variability is defined beforehand so that observation system 3 knows the time lags generated by emitter 1. In yet another embodiment, the time lag is random and is not recorded in observation system 3.

Observation system 3 comprises a receiver of the first electromagnetic radiation. The signal received by the receiver is transmitted to a computer configured to switch observation system 3 to the second operating condition after said predefined time lag. If the time lag is fixed, the computer can be a clock which triggers switching to the second operating condition. If the time lag is variable, the variability can be recorded in a memory present in observation system 3 or it can be described in the first electromagnetic radiation. If the time lag is random, switching to the second operating condition at the appropriate moment is achieved by inscribing the time lag within the signal defined by the first electromagnetic radiation, for example by means of the characteristics of the first electromagnetic radiation.

In the case of a variable or random time lag, the receiver and computer are configured to analyse the synchronization signal and to determine the value of the time lag from the characteristics of the first electromagnetic radiation.

For example purposes, the characteristics of the first electromagnetic radiation are the wavelength used, the duration of the signal, the intensity of the signal, its power distribution in time and/or in the emission spectrum. These characteristics can be used alone or in combination. In advantageous manner, the power or energy of the signal is not used as it depends greatly on the distance between the emitter of the first radiation and the receiver of this first radiation.

If the first electromagnetic radiation comprises several elementary signals separated in time or not, it is possible to use additional characteristics. For example, it is possible to use the time lag between two successive elementary signals, the difference of intensity or the sign of the difference of intensity, or the wavelengths used. It is also possible to use more conventional encoding systems, for example applying what is performed in an infrared remote control. Depending on the number of available characteristics, the signal can convey more or less complex data.

In a first example case, the first electromagnetic radiation precedes the incapacitating flash by a fixed time lag. In this way, observation system 3 receives the first electromagnetic radiation and a computer triggers switching of observation system 3, after the time lag, to the second operating mode in order to contain the flash.

In an alternative embodiment that can be combined with the previous embodiment, two successive incapacitating flashes are preceded by two first electromagnetic radiations and the time lags are different. In a particular embodiment, the time lag between the signal delivered by the first electromagnetic radiation and each incapacitating flash is calculated from data integrated in the signal coming from the first electromagnetic radiation, for example an amplitude modulation.

In an embodiment that can be combined with the previous embodiments, synchronization circuit 5 comprises a transmission/receipt circuit of an electromagnetic synchronization signal, for example in the radiofrequency range instead of a luminous or infrared signal.

Figure 2:
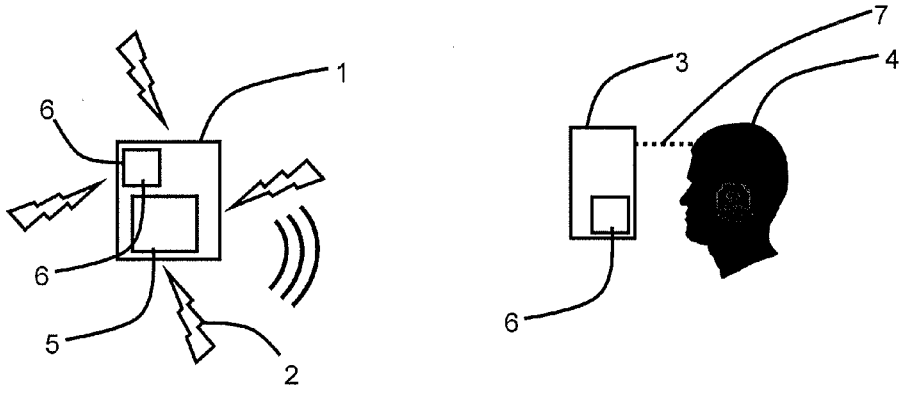

In advantageous manner illustrated in FIG. 2, emitter 1 comprises an emission circuit of the synchronization signal and observation system 3 comprises a receipt circuit of the synchronization signal.

In an alternative embodiment, synchronization circuit 5 is dissociated from emitter 1 and from observation system 3. Emitter 1 then comprises an identical device to that of observation system 3 in order to emit the flashes at the right moments. Dissociation for example enables several emitters 1 and several observation systems 3 to be used.

In these embodiments, synchronization between emitter 1 and observation system 3 is performed continually before each incapacitating flash by means of another signal.

In another embodiment, synchronization between emitter 1 and observation system 3 is performed during an initialization phase and this synchronization is kept even without exchange of synchronization signals between emitter 1 and observation system 3 and without exchange of synchronization signals between emitter 1, the observation system and the synchronization circuit. Synchronization circuit 5 is used only in the initialization and synchronization phase. Synchronization circuit 5 advantageously comprises a radiofrequency signal transmission/receipt circuit configured to initialize synchronization of emitter 1 and of observation system 3.

A memory 6 is integrated in emitter 1 and a memory 6 is integrated in observation system 3. The two memories 6 incorporate the same distribution pattern of the flashes in time, for example a mathematical sequence. Memories 6 are associated with clocks. Memories 6 integrated in emitter 1 and in observation system 3 enable these two elements to follow the same time pattern for generation of the flashes and for switching to the second operating mode after initialization. The use of memories 6 integrated in emitter 1 and in observation system 3 make it possible to avoid having to perform repeated synchronization in time and may require only an initial synchronization. Repeated synchronization in time, for example with a radiofrequency link, can be disturbed by an external device or by the configuration of the scene.

By means of this device, it is possible to perform initial synchronization of emitter 1 with observation system 3, the incapacitating flashes then being synchronized with switching to the second operating mode of observation system 3 by means of memories 6 each associated with a clock. However, it is also conceivable to provide for the use of a new external signal to force a new synchronization or to change the distribution pattern of the flashes. This change can be performed for example if the initial pattern is terminated.

In an alternative embodiment, emitter 1 and observation system 3 each comprise a transmission/receipt circuit in order to be able to communicate, for example to exchange an encryption key during the synchronization initialization phase.

The characteristics of the first electromagnetic radiation can be used to force a new initialization or to make emitter 1 and observation system 3 switch from a mode in which memories 6 are used to a mode in which synchronization is performed by signals preceding the flashes or vice-versa.

In a particular embodiment which can be combined with the previous embodiments, synchronization circuit 5 is used in an initialization phase of the synchronization procedure. Initialization phase can be performed by an electric contact existing between emitter 1 and observation system 3. Initialization of synchronization can also be performed by a radiofrequency signal or by another electromagnetic radiation. Other synchronization initialization means can be envisaged in so far as they enable emitter 1 and observation system 3 to share the same time reference.

In a particular embodiment, synchronization of emitter 1 with observation device 3 is performed by means of an external synchronization source. This external synchronization source is for example a source emitting an electromagnetic signal. In preferential manner, the external source is formed by one or more satellites such as those used for a GPS, GLONASS or Galileo global positioning system. Other sources can be used in so far as they provide a time reference.

Once the clocks of emitter 1 and of observation device 3 have been synchronized, it is possible to use observation device 3 in cooperation with the emitter. This configuration is particularly advantageous as it can be used in various and wide-ranging environments. Several emitters 1 and/or observation devices 3 are usable without having to place them all at the same place to perform synchronization.

As the internal clock of the emitter and/or of the observation device does not necessarily have the ability to maintain the required time precision over several hours or several days, it is advantageous to perform synchronization of the equipment with the external source. In this way, using a clock of lesser quality, it is possible to synchronize the emitter with the observation device precisely over long periods. Synchronization is not necessarily performed continually. The synchronization circuit is advantageously used periodically to monitor synchronization of the different elements with one another. The synchronization signal is then used as re-synchronization signal to maintain the initial synchronization or to correct a possible drift.

In a particularly advantageous embodiment, if one of the equipment units no longer receives a signal from the external source during a longer period than a threshold value, it informs the user and then switches to standby. After a certain time has elapsed, there is in fact a risk of desynchronization of the clock which becomes dangerous for the user. To inform the user, it is possible to use a visual and/or audible warning or other suitable means.

In a particularly advantageous embodiment, observation system 3 and emitter 1 are coupled to an additional circuit which enables or disables synchronization. The use of the additional circuit prevents observation system 3 and emitter 1 from being synchronized again and from operating in offset manner with other devices.

In a particular embodiment that is able to be combined with the previous embodiments, observation system 3 comprises a connector 7 connected to user 4 and it is configured in such a way as to desynchronize observation system 3 when connector 7 is no longer connected to user 4 or no longer detects user 4. In an alternative embodiment, the observation system comprises a biometric sensor which enables the user to be identified.

Connector 7 connected to user 4 can be formed by a mechanical connector, for example of cut-out type, which is configured so as to desynchronize observation system 3 when the mechanical connection no longer exists between observation system 3 and observer 4.

Connector 7 connected to user 4 can also be formed by a magnetic or electromagnetic connector of RFID type which is configured so as to desynchronize observation system 3 when the connection no longer exists between observation system 3 and observer 4. Other alternative embodiments of connector 7 are possible, for example a short-range infrared detector which detects if observer 4 removes or loses observation system 3.

The use of a connector 7 enables observation system 3 to remain synchronized so long as it is carried by observer 4. Once observation system 3 has been removed, it is desynchronized. This particularity prevents an unauthorized third party from being unable to use observation system 3 if he retrieves observation system 3 from observer 4.

In a particular embodiment, the illumination device comprises a synchronization time safety feature which is configured to desynchronize emitter 1 and/or observation systems 3 after a predefined time. The predefined time advantageously begins with the initialization phase of the different items of equipment.

In advantageous manner, the illumination device comprises at least one emitter 1 and several observation systems 3. In the case where the illumination device comprises several emitters 1 and several observation systems 3, it is advantageous to perform synchronization by means of memories 6 associated with their clocks so as to prevent interferences between the different synchronization signals.

In an embodiment which can be combined with the previous embodiments, emitter 1 is configured to deliver an emission of the electromagnetic radiation by means of flashes having a duration of less than 50 milliseconds. In advantageous manner, the time between two flashes is shorter than the recovery value of the target which depends on the luminous power emitted. For example purposes, the time between two flashes is less than 100 milliseconds. In a more general manner, it is advantageous for the duration of the flash to be shorter than the time between two flashes.

The use of short flashes makes it possible to take advantage of the persistence of vision of observer 4. In this way, observer 4 is not inconvenienced by the slight change of the luminosity received. In an embodiment that is particularly advantageous as it is easy to implement, when a light flash is emitted, observation system 3 does not transmit images to observer 4. Persistence of vision enables observer 4 to keep the previous image until observation system 3 delivers a new image.

In a preferred embodiment, the intensity of the flashes can vary between two flashes or between two series of flashes. It is also possible to modulate the duration of the flashes.

In an embodiment that is able to be combined with the previous embodiments, the emitter emits a plurality of flashes in periodic manner with a period of less than 1 second. This periodicity enables a considerable and continuous effect to be had in time on a person located in an illuminated scene.

In another embodiment that is able to be combined with the previous embodiments, the emitter emits a plurality of flashes in random manner with a period preferably greater than 1 second. This random triggering of the flashes creates a surprise effect on a person located in the illuminated scene.

According to the configuration of the scene, emitter 1 can be supplied by a mobile power source or by means of a fixed electric mains power system. Power supplier of the emitter by a mobile source or by a mains power source can fix the maximum energy delivered by emitter 1.

Observation system 3 can be achieved simply by a pair of glasses which comprise lenses or filters having variable transmission coefficients, for example of all-or-nothing type. The lens or filter can be formed from a material which comprises variable optical properties according to the electric polarization conditions applied. For example, observation system 3 comprises a battery which applies a potential difference on the lens so as to modify its optic transmission coefficient. In this configuration, the two lenses forming the pair of glasses are modified simultaneously. This embodiment is simple to implement as it does not require the use of complex electronics and keeps a very low power consumption.

In the case where observation system 3 is a light intensification device or an infrared detection device, for example a night vision device, the polarization conditions of the optic sensor are modified in order to take account of the high luminosity to come or a branch circuit is actuated in order to divert the surplus current originating from the surplus light received. It is also conceivable to cut the connection between the light sensor and the screen retransmitting an image representative of the scene in order to avoid dazzling observer 4.

In advantageous manner, the second operating condition of observation system 3 is applied over a longer duration than the flash so as to completely encompass the duration of the light flash. Observation system 3 thus applies the second operating condition before emission of the flash and this second operating condition is still applied after the flash has terminated. This precaution provides a safeguard against the margin of error in synchronization between emitter 1 and observation system 3. This also enables the latency and the margin of error on the latency of the observation system to be taken into account when switching from the first operating mode to the second operating mode. In a preferred embodiment, emitter 1 and observation system 3 comprise high-precision clocks.

This device safeguards against dazzling when the illuminated scene comprises for example a mirror or another reflecting element.

The invention claimed is:

1. An illumination device comprising:

an emitter of electromagnetic radiation having a wavelength comprised in the visible spectrum and/or in the infrared range and designed to illuminate a scene, the emitter being configured to deliver an emission of the electromagnetic radiation by at least one flash with a luminous power greater than a threshold generating dazzling, an observation system configured to deliver an image representative of the illuminated scene to an observer carrying said observation system, the observation system being configured to present a first operating condition and a second operating condition, the second operating condition transmitting less luminous power to the observer than the first operating condition, a synchronization circuit configured to synchronize the emitter and the observation system so that the observer is not dazzled during emission of a flash by the emitter, wherein the emitter and the observation system each comprise a clock and a memory incorporating the distribution pattern of a plurality of flashes in time and wherein the synchronization circuit comprises a transmission/receipt circuit of a synchronization signal configured to initialize synchronization of the emitter and of the observation system.

2. The device according to claim 1, wherein the synchronization circuit comprises an external source delivering an electromagnetic synchronization signal.

3. The device according to claim 1, wherein the emitter comprises an emission circuit configured for emitting a first electromagnetic radiation preceding emission of a flash with a predefined time lag and wherein the observation system comprises a receiver of said first electromagnetic radiation and a computer configured to switch the observation system to the second operating condition after said predefined time lag.

4. The device according to claim 3, wherein the receiver and computer are configured to analyze the first electromagnetic radiation and to determine a value of said time lag from characteristics of the first electromagnetic radiation.

5. The device according to claim 1, wherein the observation system comprises a connector designed to be connected to a user and configured so as to desynchronize the observation system when the connector is no longer connected to the observer.

6. The device according to claim 1, wherein the emitter is configured to deliver flashes each having a duration of less than 50 milliseconds.

7. The device according to claim 1, wherein the observation system is a pair of glasses comprising transmission filters with a variable transmission coefficient.

8. The device according to claim 1, wherein the observation system is a light intensification device or an infrared detection device.

* * * * *